United States Patent [19]

Ferraro

[11] Patent Number: 4,768,021

[45] Date of Patent: Aug. 30, 1988

[54] SAFE FOR LOADED HAND GUN

[76] Inventor: Michael P. Ferraro, 96 Westminster St., New Haven, Conn. 06513

[21] Appl. No.: 99,334

[22] Filed: Sep. 18, 1987

[51] Int. Cl.[4] ..... G08B 13/00

[52] U.S. Cl. ..... 340/568; 70/63; 70/159; 109/38; 109/53; 340/540; 340/543; 340/665; 340/825.31

[58] Field of Search ..... 340/665, 568, 540, 506, 340/543, 825.31, 825.34; 109/38, 53; 70/63, 159

[56] References Cited

U.S. PATENT DOCUMENTS

| | | | |
|---|---|---|---|
| 2,353,452 | 7/1944 | Fruh | 340/506 |
| 2,754,498 | 7/1956 | Lavelle | 340/568 |
| 4,577,345 | 3/1986 | Abramov | 340/825.34 |
| 4,663,621 | 5/1987 | Field et al. | 340/825.31 |

*Primary Examiner*—Glen R. Swann, III

*Attorney, Agent, or Firm*—CTC & Associates

[57] ABSTRACT

A safe for a loaded hand gun has a box which includes a receptacle for containing the gun. The receptacle has a bottom providing a mounting surface. A lid is hingedly mounted on the box and is movable between a closed position covering the receptacle and an open position in which the gun is accessible. A locking device normally holds the lid in its closed position, and a touch pad mechanism is operable only by authorized personnel provides for releasing the locking device when access to the gun is desired, permitting the lid to move to its open position. The touch pad may be a numerical touch pad, an alphabetical touch pad or a fingerprint indentification touch pad. The mounting surface has a mounting hole for use in attaching the safe to another structure. A pressure sensitive pad is affixed to the mounting surface at the mounting hole and is positioned to be overlapped by the head of a mounting screw. An audible alarm system is actuatable by the pressure sensitive pad in the event of unauthorized attempted forcible removal of the safe from the structure on which the safe is mounted will cause the screw head to apply a squeezing pressure to the pad.

11 Claims, 2 Drawing Sheets

SAFE FOR LOADED HAND GUN

BACKGROUND OF THE INVENTION

This invention relates to a safe for a loaded hand gun, and more particularly to such a safe for use by an individual for storing a loaded hand gun in the home.

There are a number of characteristics and advantages which should be possesed by such a safe. Thus, the safe should offer substantially instantaneous access to its interior, but only to its owner, even in total darkness. Further, the safe should be mountable on any desired surface, in such a way that it may not be removed therefrom by an unauthorized person without setting off an audible alarm.

Additionally, the safe should be economical to manufacture and should have an attractive appearance.

As far as is known, no prior art gun lock possesses the foregoing advantages.

An ever increasing number of people are keeping hand guns in their homes for protection. Keeping a loaded hand gun in the home is a constant worry, because of potential accidents and the possibility of coming home and finding an intruder waiting with the home owner's own gun. As far as is known, all hand gun locks on the market require keys for access. These types of hand gun locks do keep a gun from being discharged, but the key must be kept in another location, separate from the gun lock. The result is that when the home owner suddenly realizes that he needs his gun because of the presence of an intruder, much time could be lost searching for the key in darkness. Alternatively, if a gun lock is not used and the gun is kept unloaded in a closet, even more time can be lost in a crisis situation.

The present invention eliminates these unsafe and time losing situations presently associated with keeping a hand gun in the home for protection.

Accordingly, important objects of the invention are to provide a safe for a loaded hand gun having the foregoing advantages.

SUMMARY OF THE INVENTION

A safe for a loaded hand gun has a box which includes a receptacle for containing the gun. The receptacle has a bottom providing a mounting surface. A lid is hingedly mounted on the box and is movable between a closed position covering the receptacle and an open position in which the gun is accessible. A locking device normally holds the lid in its closed position, and keyless mechanism operable only by authorized personnel is provided for releasing the locking device when access to the gun is desired, permitting the lid to move to its open position. The mounting surface has a mounting hole for use in attaching the safe to other structure. A pressure sensitive pad is affixed to the mounting surface at the mounting hole and is positioned to be overlapped by the head of a mounting screw. An audible alarm system is actuatable by the pad in the event of unauthorized attempted forcible removal of the safe from the other structure which will cause the screw head to apply a squeezing pressure to the pad.

DESCRIPTION OF THE INVENTION

Figure 1:
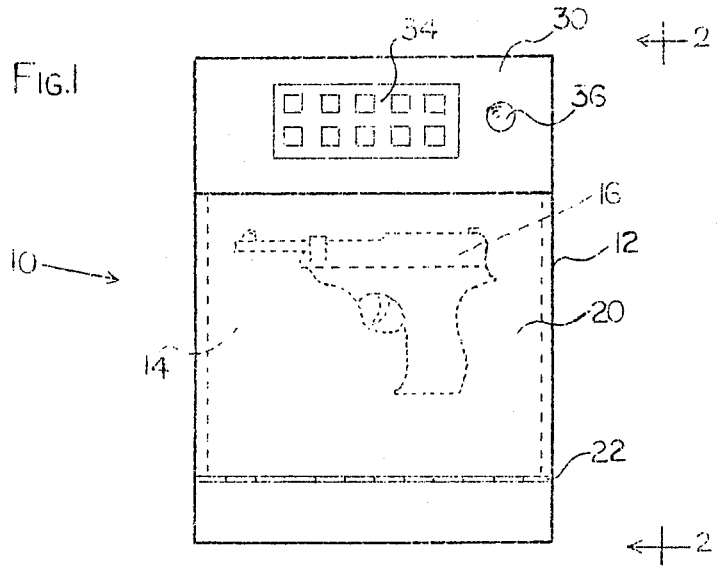
FIG. 1 is a somewhat schematic plan view of a safe that is a preferred embodiment of the invention, showing the lid closed.
Figure 2:
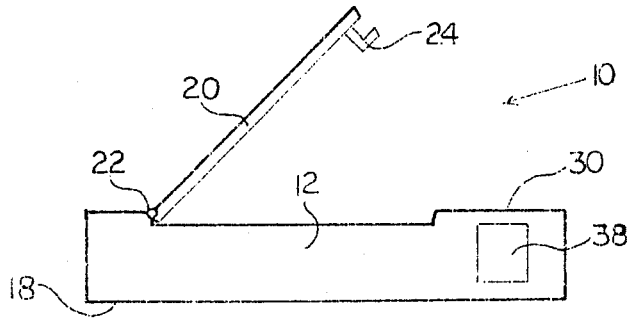
FIG. 2 is a view on line 2—2 of FIG. 1, but showing the lid open.
Figure 3:
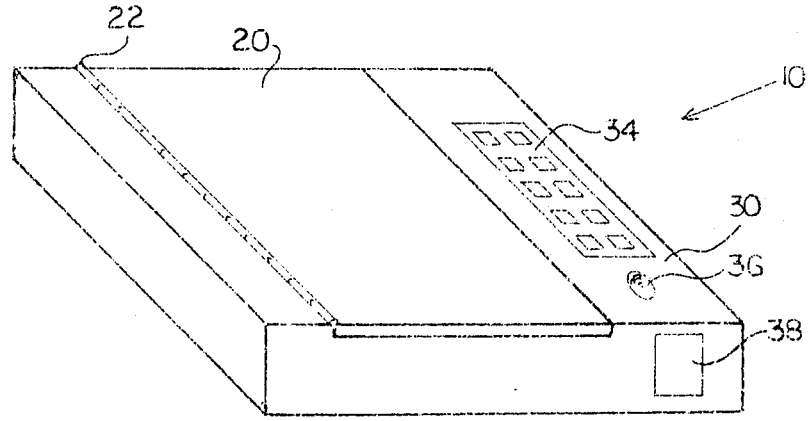
FIG. 3 is an enlarged perspective view of the safe of FIG. 1.
Figure 4:
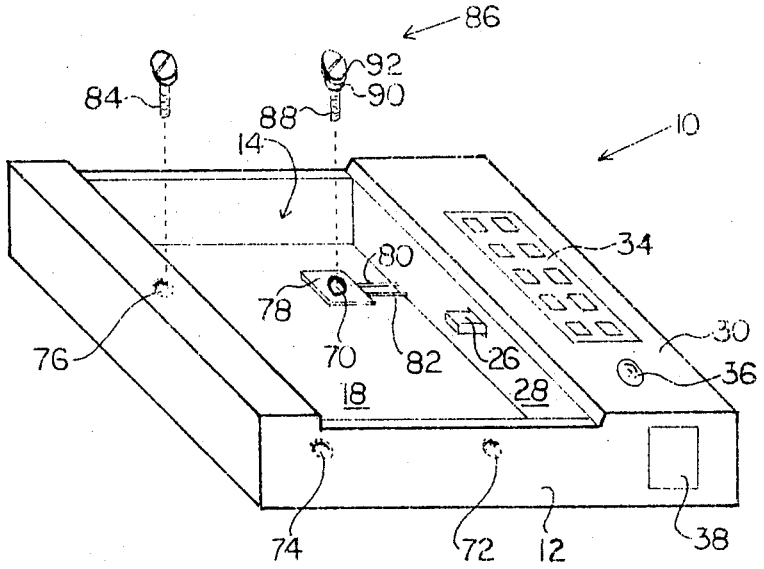
FIG. 4 is a view similar to FIG. 3 but with the lid removed, showing mounting holes, at one of which is a pressure sensitive pad for activating an alarm system.

FIGS. 1, 2, 3 and 4 illustrate a safe 10 that is a preferred embodiment of the invention. Safe 10 comprises a structure in the general form of a box 12 which includes a receptacle 14 sized and shaped to receive a loaded hand gun 16. Receptacle 14 has a bottom which provides safe 10 with a mounting surface 18. Safe 10 further comprises a lid 20 connected to box 12 by a hinge 22, of any suitable type, such as a piano type hinge. Hinge 22 is located near one end of box 12, and lid 20 is movable between a closed position (FIGS. 1 and 3) in which lid 20 covers and does not permit access to receptacle 14 and an open position (FIG. 2) in which gun 16 is accessible. Spring means (not shown) biases lid 20 toward its open position.

Box 12 and lid 20 may be of any suitable durable material such for example as steel or high strength, high impact plastic material.

Safe 10 also comprises a locking device for holding lid 20 in its closed position and means for releasing the locking device when access to gun 16 is desired. The locking device may include a cleat 24 (FIG. 2) on the end of lid 20 remote from hinge 22 and a bolt 26 mounted in a wall 28 of a closed housing 30 remote from hinge 22. In its normal or locking position, bolt 26 projects from wall 28 into interengagement with cleat 24, as by overlapping same to hold lid 20 in its closed position.

Safe 10 is also provided with means for releasing the locking device when access to gun 16 is desired. When activated, the releasing means withdraws bolt 26 from interengagement with cleat 24, permitting the spring means or the owner to move lid 20 to its open position, thus giving access to gun 16.

In safe 10, the means for releasing the locking device includes a 10-character touch pad 34 mounted on housing 30. The characters may be numerals, or letters, or other indicia.

Housing 30 provides an enclosure for electric circuitry and also has adjacent touch pad 34, a low current warning lamp 36 that will light up to indicate that the DC battery needs replacement. A removable cover 38 on one side of housing 30 provides access to a battery pack, which provides DC power for operating safe 10.

The electric circuitry of safe 10 includes a known electronic memory which is programmable in known fashion to accept a three-character unlocking code to activate the means for releasing the locking device.

The operation of safe 10 will now be described. Loaded hand gun 16 is placed in receptacle 14, with lid 20 in its open position after which lid 20 is moved to its closed position, automatically locking therein.

Now assume the time has come that the owner of safe 10 desires access to gun 16. To accomplish this, the owner merely presses any character or characters on touch pad 34 to activate the battery powered circuitry.

At this time all ten characters on touch pad 34 illuminate, and the means for releasing the locking device is automatically ready to receive a three character unlocking code from touch pad 34. After the three-character unlocking code is entered into touch pad 34, lid 20 is unlocked and gun 16 can be removed from receptacle 14. If the unlocking code is not entered into touch pad 34 within twelve to fifteen seconds after the power circuit is activated the DC power automatically terminates. Current is used only during the activation time of the power circuit to the touch pad and for the actual unlocking of lid 20. The three-character unlocking code can be changed by the owner at will.

Figure 5:
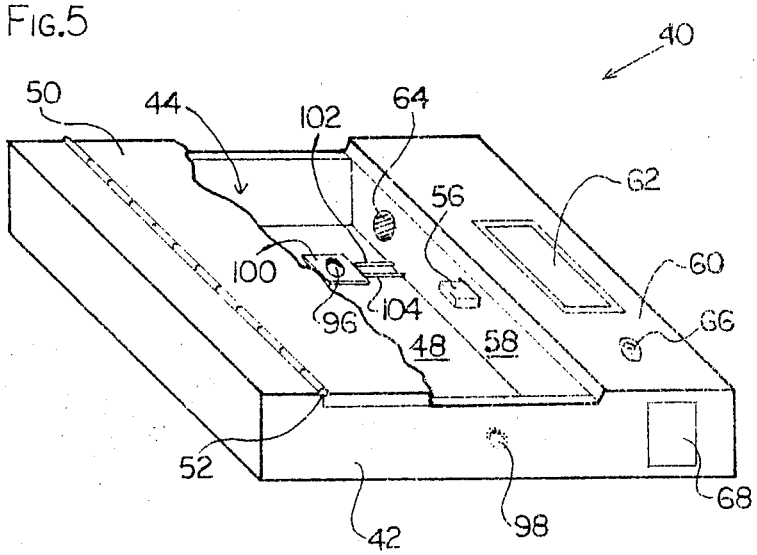
FIG. 5 is a view similar to FIG. 3 of a modified safe that is another preferred embodiment of the invention, showing the lid broken away.

FIG. 5 illustrates a modified safe 40 that is another preferred embodiment of the invention. Safe 40 is similar to safe 10, having a box 42 including a receptacle 44, a mounting surface 48, a lid 50, a hinge 52, and a locking device like that is provided by a cleat (not shown, but like cleat 24), and a bolt 56 mounted in a wall 58 of a closed housing 60. Safe 40 has a touch pad 62 which is a fingerprint identification pad which is operable with an electronic memory capable of remembering two preselected fingerprint identifications which may be a fingerprint of the owner of safe 40 and a fingerprint of another person, typically the owner's spouse. The programming of touch pad 62 is accomplished by pressing a program memory button 64 located on wall 58. The owner of safe 40 places a finger on touch pad 62 and then presses the program memory button 64. The electronic memory at this time will activate and record the owner's fingerprint for future reference to unlock safe 40. The other person does likewise.

Like safe 10, safe 40 also has a low current lamp 66 adjacent touch pad 62 and, on one side of housing 60, a cover 68 providing access to a battery pack, which provides DC power for operating safe 40. Like lamp 36, lamp 66 lights up to indicate the need for battery replacement.

As shown, boxes 12 and 42 are similar, as are receptacles 14 and 44, mounting surfaces 18 and 48, lids 20 and 50, hinges 22 and 52, bolts 26 and 56, walls 28 and 58, housings 30 and 60, lamps 36 and 66 and covers 38 and 68.

In safe 40, the means for releasing the locking device includes touch pad 62, which, as aforesaid, is a fingerprint identification pad, and the operation of safe 40 is substantially the same as that of safe 10, except that in safe 40, the means for releasing the locking device activates upon presentation to touch pad 62 of either of the two preselected fingerprint identifications. Safe 40 uses and conserves electric power in the same manner as safe 10.

Remaining for description is another important feature of safes 10 and 40, namely, an audible alarm system that is actuatable in the event of unauthorized attempted removal of the safe from structure, such as a wall in a closet or the bottom of a drawer on which the safe is mounted. It will be seen from FIG. 4 that safe 10 is provided with four mounting holes through mounting surface 18. These are mounting holes 70, 72, 74 and 76, of which holes 70 and 72 are adjacent wall 28 and holes 74 and 76 are remote from wall 28. Holes 70, 72, 74 and 76 may be sized as clearance holes for ¼ inch (0.635 cm) diameter external threads on mounting bolts.

A pressure sensitive pad 78 is affixed to mounting surface 18 at either hole 70 or hole 72 (these being the holes adjacent wall 28). As shown, pad 78 is associated with hole 70. A predetermined critical squeezing pressure applied to opposite faces of pad 78 completes an electric circuit through pad 78. Pad 78 has leads 80 and 82 which pass through wall 28 to an alarm system (not shown) within housing 30.

Three standard mounting screws 84 of ¼ inch thread size are used in mounting holes 72, 74 and 76 and aligned holes in the structure on which safe 10 is being mounted. A special screw 86 having a threaded shank portion 88 of the same thread size but having a ⅜ inch (0.95 cm) diameter unthreaded shank portion 90 between shank portion 88 and a head 92 is used in mounting hole 70. Pad 78 has a hole therethrough which is entered by shank portion 90 of screw 86, so that shank portion 90 prevents screw 86 from applying the predetermined critical squeezing pressure to pad 78 during the mounting of safe 10.

However, when unauthorized forceful pulling pressure is thereafter applied to safe 10 seeking to dislodge safe 10 from the surface on which it is mounted, bolt head 92 will apply a squeezing pressure to pad 78 in excess of a predetermined critical pressure, thus completing an alarm circuit through pad 78.

The audible alarm is a high pitched beeping sound which continues for three to five minutes and then shuts off, and the alarm automatically then resets for protection against any further attempts at removal by an unauthorized person, such as an intruder. The alarm does not use any battery current while armed and would cause the intruder to stop any further effort to remove safe 10 from its mounting surface, and probably to vacate the premises.

Furthermore, if desired, the alarm system may be connected to any existing security system on the premises.

Safe 40, like safe 10, is provided with mounting holes through mounting surface 48, two of which mounting holes are shown adjacent wall 58 at 96 and 98, with a pressure sensitive pad 100 with leads 102 and 104 being associated with hole 96, in the same manner in which pad 78 is associated with hole 70. Safe 40 is mountable on other structure with the aid of mounting screws 84 and 86, the latter being used in mounting hole 96. Leads 102 and 104 are connected to an alarm system (not shown) within housing 30. The alarm system in safe 40 is the same as that in safe 10.

If the alarm system of safe 10 or safe 40 becomes actuated, as while being tested, for example, it can be shut off by activating the means for releasing the locking device, as aforesaid.

The invention well attains the foregoing objects and advantages and others.

The disclosed details are exemplary only and are not to be taken as limitations on the invention except as those details are included in the appended claims.

What is claimed is:

1. A safe for a loaded hand gun, said safe comprising a box including a receptacle for containing the gun, said receptacle having a bottom providing a mounting surface, a lid hingedly mounted on said box and movable between a closed position covering said receptacle and an open position in which the gun is accessible, a locking device for normally holding said lid in its said closed position, means for releasing said locking device when access to the gun is desired, said releasing means being operable without a key and solely by authorized personnel, said mounting surface having a mounting hole for use in attaching said safe to another structure, a pressure sensitive pad affixed to said mounting surface at said mounting hole and positioned to be overlapped by the head of a mounting screw, and an alarm system actuatable by said pad in the event of unauthorized attempted forcible removal of said safe from the other structure which will cause the head of the mounting screw to apply a squeezing pressure to said pad.

2. A safe according to claim 1 wherein said means for releasing said locking device includes a touch pad.

3. A safe according to claim 2 wherein said touch pad is a numerical touch pad.

4. A safe according to claim 2 wherein said touch pad is an alphabetical touch pad.

5. A safe according to claim 2 wherein said touch pad is a fingerprint identification touch pad.

6. A safe according to claim 1 said alarm system generates an audible signal when a squeezing pressure in excess of a predetermined critical pressure is applied to said pad.

7. A safe for a loaded hand gun, said safe comprising a box including a receptacle for containing the gun, said receptacle having a bottom providing a mounting surface, a lid hingedly mounted on said box and movable between a closed position covering said receptacle and an open position in which the gun is accessible, a locking device for normally holding said lid in its said closed position, means for releasing said locking device when access to the gun is desired, said releasing means being operable without a key and solely by authorized personnel, and spring means for biasing said lid toward its open position.

8. A safe according to claim 3 wherein said means for releasing said locking device includes a touch pad.

9. A safe according to claim 8 wherein said touch pad is a numerical touch pad.

10. A safe according to claim 8 wherein said touch pad is an alphabetical touch pad.

11. A safe according to claim 8 wherein said touch pad is a fingerprint identification touch pad.

* * * * *

US004768021C1

(12) REEXAMINATION CERTIFICATE (4616th)

United States Patent

Ferraro

(10) Number: US 4,768,021 C1

(45) Certificate Issued: Jul. 23, 2002

(54) SAFE FOR LOADED HAND GUN

(75) Inventor: Michael P. Ferraro, New Haven, CT (US)

(73) Assignee: JMF Products, LLC, North Haven, CT (US)

Reexamination Request:
No. 90/005,895, Dec. 22, 2000

Reexamination Certificate for:

| | |
|---|---|
| Patent No.: | **4,768,021** |
| Issued: | **Aug. 30, 1988** |
| Appl. No.: | **07/099,334** |
| Filed: | **Sep. 18, 1987** |

(51) Int. Cl.[7] ..... G08B 13/14

(52) U.S. Cl. ..... 340/568.1; 340/506; 340/540; 340/543; 340/665; 340/825.34; 109/38; 109/53; 70/63; 70/159

(58) Field of Search ..... 340/665, 568, 340/540, 506, 543, 825.31, 825.34; 109/38, 53; 70/63, 159

(56) References Cited

U.S. PATENT DOCUMENTS

| | | | |
|---|---|---|---|
| 4,059,737 | A | 11/1977 | Gergaud |
| 4,577,345 | A | 3/1986 | Abramov |
| 4,663,621 | A | 5/1987 | Field et al. |

FOREIGN PATENT DOCUMENTS

| | | |
|---|---|---|
| DE | GM 1 707 023 | 9/1955 |
| DE | GM 7 910 097 | 7/1997 |
| FR | 2 561 624 | 9/1985 |

OTHER PUBLICATIONS

Meilink Customer Price Schedule: Money Safes & Depositories, Sep. 1, 1981.

Johnson Pacific Safe Company: Commercial and Home Sales, Catalog.

*Primary Examiner*—Julie Lieu

(57) ABSTRACT

A safe for a loaded hand gun has a box which includes a receptacle for containing the gun. The receptacle has a bottom providing a mounting surface. A lid is hingedly mounted on the box and is movable between a closed position covering the receptacle and an open position in which the gun is accessible. A locking device normally holds the lid in its closed position, and a touch pad mechanism is operable only by authorized personnel provides for releasing the locking device when access to the gun is desired, permitting the lid to move to its open position. The touch pad may be a numerical touch pad, an alphabetical touch pad or a fingerprint indentification touch pad. The mounting surface has a mounting hole for use in attaching the safe to another structure. A pressure sensitive pad is affixed to the mounting surface at the mounting hole and is positioned to be overlapped by the head of a mounting screw. An audible alarm system is actuatable by the pressure sensitive pad in the event of unauthorized attempted forcible removal of the safe from the structure on which the safe is mounted will cause the screw head to apply a squeezing pressure to the pad.

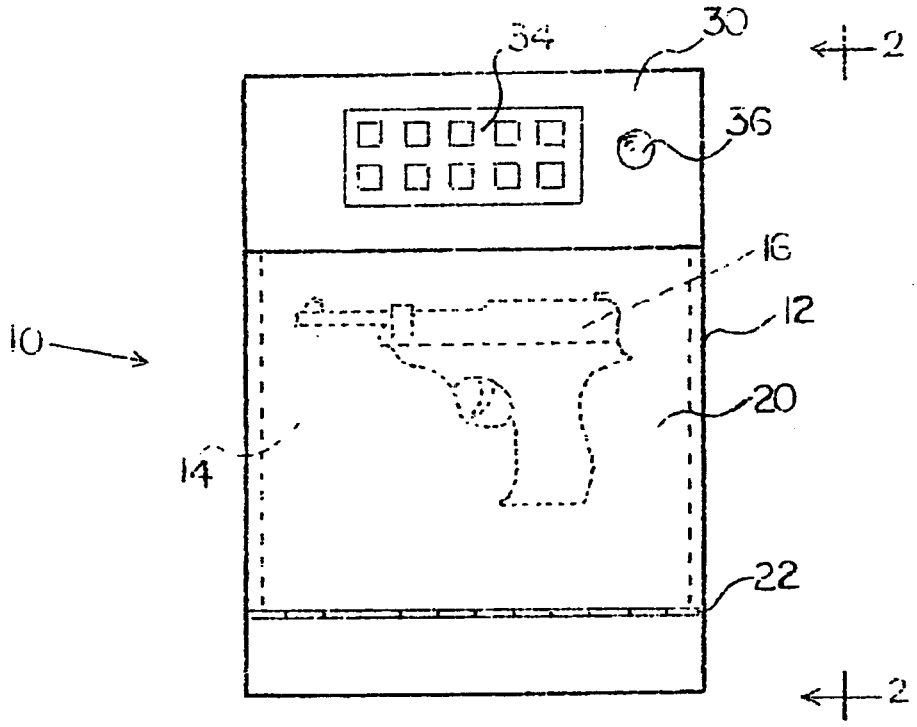

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–6 is confirmed.

Claims 7–11 are cancelled.

* * * * *